US006087822A

United States Patent [19]

van der Veen

[11] Patent Number: 6,087,822

[45] Date of Patent: Jul. 11, 2000

[54] POWER TRANSFORMER WITH INTERNAL DIFFERENTIAL MODE DISTORTION CANCELLATION

[75] Inventor: Menno van der Veen, De Zwolle, Netherlands

[73] Assignee: ir.buro Vanderveen, DeZwolle, Netherlands

[21] Appl. No.: 09/414,172

[22] Filed: Oct. 7, 1999

[30] Foreign Application Priority Data

Oct. 9, 1998 [GB] United Kingdom ..... 9822097

[51] Int. Cl.[7] ..... H01F 27/42

[52] U.S. Cl. ..... 323/356; 323/363

[58] Field of Search ..... 323/355, 356, 323/361, 363

[56] References Cited

U.S. PATENT DOCUMENTS

| | | | |
|---|---|---|---|
| 2,446,033 | 7/1948 | Wellings | 336/178 |
| 3,299,384 | 1/1987 | Hua-Tung Lee | 336/171 |
| 3,699,385 | 10/1972 | Paget | 315/239 |
| 3,956,717 | 5/1976 | Fischer et al. | 333/121 |
| 4,032,836 | 6/1977 | Gross | 323/356 |
| 4,514,764 | 4/1985 | Borg et al. | 348/554 |
| 4,639,663 | 1/1987 | Ueno et al. | 323/356 |
| 4,668,934 | 5/1987 | Shuey | 340/310 |
| 5,341,281 | 8/1994 | Skibinski | 363/39 |
| 5,515,433 | 5/1996 | Chen | 379/398 |
| 5,598,480 | 1/1997 | Kim | 381/99 |
| 5,623,543 | 4/1997 | Cook | 379/402 |
| 5,717,685 | 2/1998 | Abraham | 340/310 |
| 5,920,155 | 7/1999 | Kanda et al. | 315/307 |
| 5,991,142 | 11/1999 | Appelbaum et al. | 361/179 |

FOREIGN PATENT DOCUMENTS

| | | | |
|---|---|---|---|
| 0149169 | 7/1985 | European Pat. Off. | H01F 27/38 |
| 57196509 | 2/1982 | Japan | H01F 19/04 |
| 683621 | 12/1952 | United Kingdom | H01F 19/04 |

OTHER PUBLICATIONS

Hiroaki Kitagawa; "Arrangement of Winding in Three Winding Transformer," Patent Abstracts of Japan, vol. 12, No. 130, 1988.

International Search Report of PCT/CA 99/00918.

*Primary Examiner*—Adolf Deneke Berhane
*Assistant Examiner*—Bao Q. Vu
*Attorney, Agent, or Firm*—F. Chau & Associates, LLP

[57] ABSTRACT

A power transformer with internal differential mode distortion cancellation, comprising a primary coil for connection to a power source providing a fundamental frequency power signal, a secondary coil for connection to an electrical load, a magnetic core intermediate the primary coil and secondary coil for providing mutual magnetic couplings of signals therebetween, a further coil connected with opposite phase to one of either the primary coil and the secondary coil, and a high-pass filter connected in series with the further coil for attenuating said fundamental frequency power signal while passing high frequency distortion signals substantially unattenuated, whereby the high frequency distortion signals are canceled in the magnetic core.

15 Claims, 8 Drawing Sheets

POWER TRANSFORMER WITH INTERNAL DIFFERENTIAL MODE DISTORTION CANCELLATION

FIELD OF THE INVENTION

This invention relates in general to power transformers and more particularly to a power transformer design with internal circuitry for canceling differential mode harmonic distortion.

BACKGROUND OF THE INVENTION

Power transformers are well known in the art for providing rated voltage and current to electric and electronic devices while isolating those devices from the AC current mains. Ideally, the mains should deliver pure undistorted sinusoidal signals to the primary side of the power transformer. However, in practical applications, this is often not the case. Harmonic components of the fundamental frequency (50 or 60 Hertz) are almost always present, as well as unrelated higher frequency voltages which may be caused by any of a number of sources. For example, spike signals from lightning or the switching of motors, radio frequency signals, digital signals from computer systems, asymmetrical loading of the mains, communication signals, etc., all may contribute to harmonic distortion of the mains power signal.

It is also known that such distortion can, depending on severity, interfere with the optimal functioning of the electrical or electronic equipment connected to the mains, or cause damage to the equipment. In Europe, for instance, three classes have been defined under the recent CE regulations relating to mains distortion. Class A equipment is insensitive to distortion. Class B equipment is influenced to a limited extent by mains distortion without affecting fundamental tasks. Class C equipment ceases functioning under the influence of distortion, but by resetting the equipment, the functioning of the equipment can continue.

Accordingly, the elimination of mains distortion is widely recognized in the art as being highly desirable.

One solution to the problem of eliminating harmonic distortion involves rectifying and buffering the distorted signal to create new pure undistorted sinusoidal voltage signals. This solution is well known in the art of uninterruptable power supplies for use with computers.

Another prior art solution involves the use of resonant transformers which resonate only at the fundamental frequency and therefore attenuate all other frequencies.

Yet another solution involves the creation of "balanced" power lines by means of an external isolation transformer wherein the center tap of the secondary winding is connected to ground, thereby creating two outputs which pass the differential mode distortion in opposite phase.

In all of the foregoing prior art solutions, external elements are required to be added to the power transformer in order to remove differential mode distortion. These solutions introduce additional circuit complexity and attendant costs.

A sample of exemplary prior art patents in the field of transformer means distortion cancellation include:

U.S. Pat. No. 5,640,314 (Glasband et al)

U.S. Pat. No. 5,343,080 (Kammeter)

U.S. Pat. No. 5,206,539 (Kammeter)

U.S. Pat. No. 5,434,455 (Kammeter)

SUMMARY OF THE INVENTION

According to the present invention, a power transformer is provided with a series connected auxiliary coil and high-pass filter connected in opposite phase to the main coil in one or both of the main and secondary windings, so that high frequency harmonic distortion is magnetically canceled in the core of the transformer while the fundamental power frequency passes unattenuated. This structure provides a unique advantage over prior art designs by eliminating costly and expensive external filtering circuitry. Furthermore, according to an aspect of the invention the transformer characteristics (transfer function, impedance, current and phase angle) may be controlled by varying circuit parameters of the transformer.

BRIEF DESCRIPTION OF THE DRAWINGS

A detailed description of the preferred embodiment and alternative embodiments is provided herein below with reference to the following drawings, in which.

DETAILED DESCRIPTION OF THE PREFERRED AND ALTERNATIVE EMBODIMENTS

Figure 1:
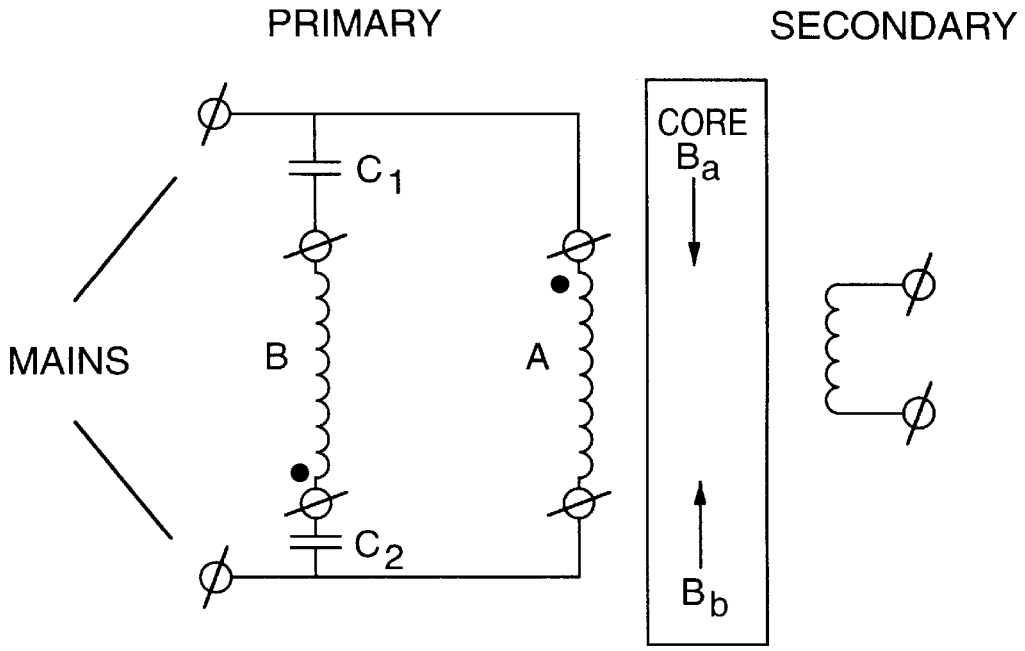
FIG. 1 is a schematic illustration of the power transformer according to the present invention with series auxiliary coil and high pass filter connected in opposite phase to the primary coil.

Turning to FIG. 1, a power transformer is shown according to the present invention comprising a primary side and secondary side separated by a magnetic core, in the usual manner. However, in accordance with the present invention, an auxiliary primary coil B is provided having the same number of turns as the main primary winding A, but connected in opposite phase thereto. Furthermore, a pair of capacitors $C_1$ and $C_2$ are connected in series with the auxiliary coil B, forming a high pass filter. It will be apparent to persons of ordinary skill in the art that the high pass filter function may be implemented using a single capacitor, series capacitor and resistor, or any other appropriate frequency dependent structure, and is not limited to the two-capacitor implementation shown in FIG. 1.

According to the preferred embodiment, the windings A and B are of bifilar construction. However, as discussed in greater detail below, this is not a requirement of the invention. Indeed, as discussed in greater detail below, optimal tuning of the mutual coupling between the windings permits control of the transformer transfer function, phase angle between primary currents and voltages and total primary impedance. In fact, the main and auxiliary windings may be characterized by any reasonable mutual coupling between zero (i.e. none) and almost one (i.e. bifilar).

The selection of bifilar windings A and B ensures very small leakage between the two windings, so that each winding exercises the same magnetic effect on the core of the transformer.

The values of the capacitors $C_1$ and $C_2$ are chosen such that above the mains fundamental frequency, the primary impedance becomes small. At such frequencies, the capacitors $C_1$ and $C_2$ behave as short circuit elements. Accordingly, high frequency distortion in the mains power signal result in currents flowing in opposite directions through both windings A and B. These currents result in magnetic flux densities $B_a$ and $B_b$ in the transformer coil. Since the magnetic flux densities $B_a$ and $B_b$ have equal magnitude but opposite phase, they cancel out, resulting in zero flux density in the core of the transformer at frequencies above the cut off frequency of the high-pass filter device.

Figure 2:
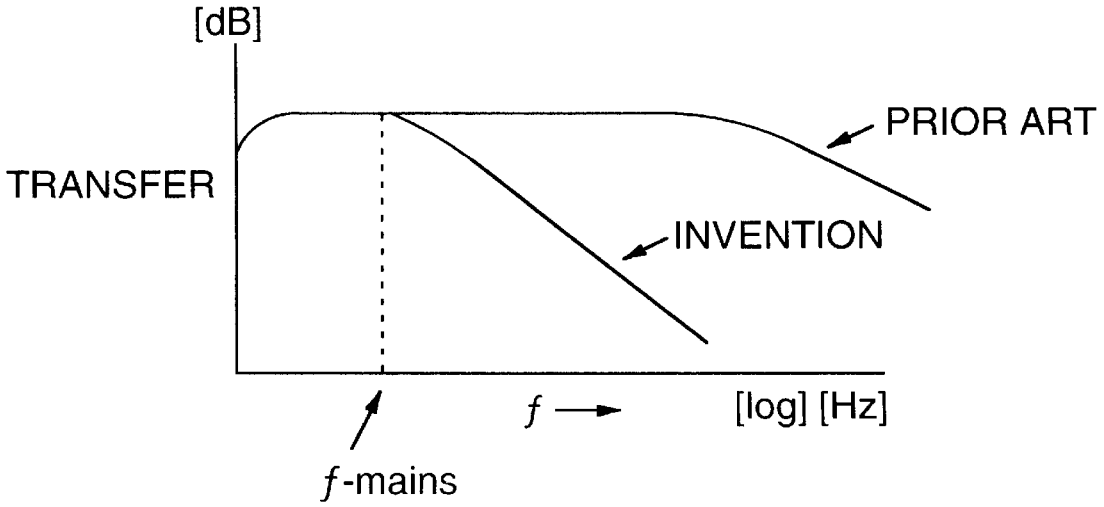
FIG. 2 is a graph showing power transfer across the transformer of FIG. 1 as a function of frequency.

FIG. 2 is a simplified graph showing the transfer of power, in dB, from the primary side to the secondary side of the transformer of FIG. 1 as a function of frequency. According to the prior art, (i.e. transformer design without distortion elimination), the pass band for high frequency distortion signals is large. By way of contrast, according to the present invention, distortion signals above the high-pass filter cut off frequency are significantly attenuated.

Figure 3:
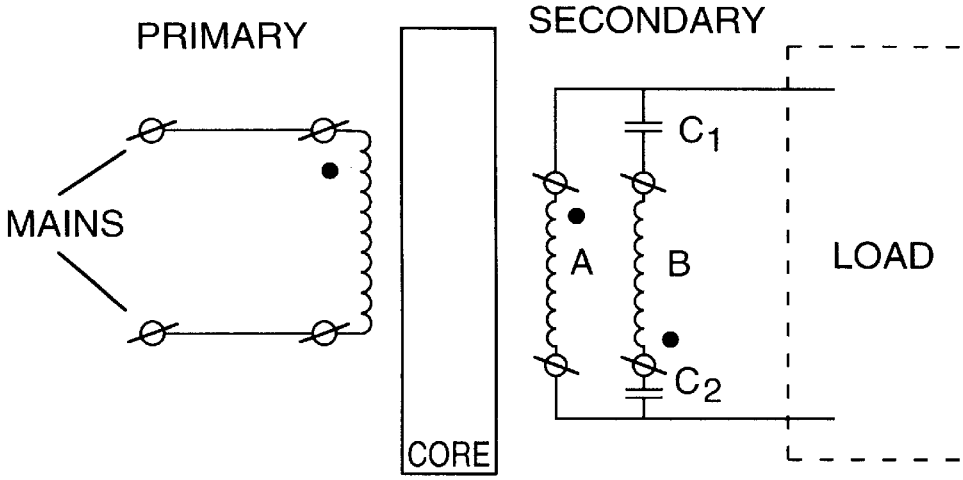
FIG. 3 is a power transformer according to a first alternative embodiment of the present invention with auxiliary coil and high-pass filter connected in opposite phase to the secondary transformer coil.

FIG. 3 shows an embodiment of the invention in which the auxiliary coil B is connected in opposite phase to the main coil A on the secondary side of the transformer. Thus, where the load generates high frequency distortion signals (e.g. as a result of digital switching), these signals are coupled to the transformer core with equal and opposite phase by the secondary coils A and B, whereas the mains fundamental frequency signals are passed only by the secondary coil A, having been filtered by capacitors $C_1$ and $C_2$ connected to coil B. This configuration is useful for preventing high frequency signals generated on the secondary side from being passed to the power mains.

Figure 4:
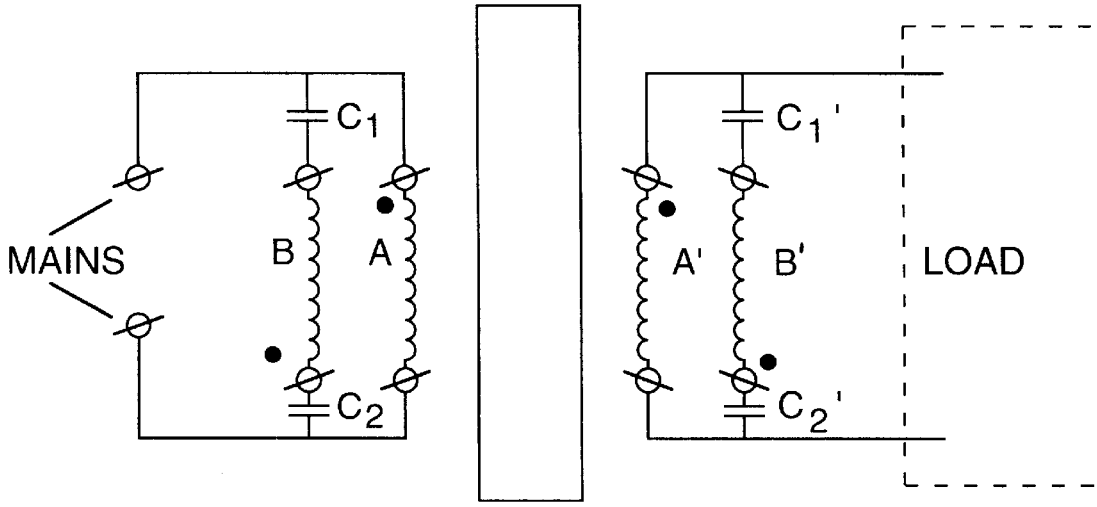
FIG. 4 is a schematic illustration of a power transformer according to a further alternative embodiment of the present invention with auxiliary coils and high pass filter elements connected in opposite phase to both the primary and secondary transformer coils.

FIG. 4 shows an embodiment of the invention with distortion canceling auxiliary coils B and B' and high pass filter devices $C_1$, $C_2$, and $C_1'$, $C_2'$ connected to the main coils in both the primary and secondary sides of the transformer.

Figure 5:
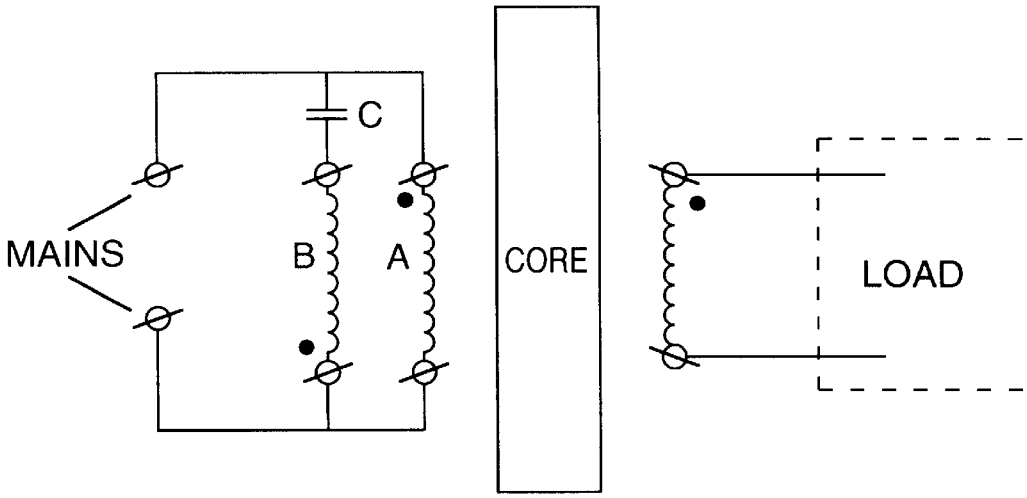
FIG. 5 is a schematic illustration of an embodiment of the invention similar to FIG. 1 wherein the high pass filter element is implemented using a single capacitor.

FIG. 5 shows an embodiment of the invention similar to FIG. 1, wherein only a single capacitor C is used to implement the high pass filter function.

Thus, according to a general aspect of the present invention, a power transformer is provided wherein the net flux density in the magnetic core is canceled for frequencies above the cut off frequency of a high-pass filter in the auxiliary coil (FIGS. 1, 3 and 5) or multiple auxiliary coils (FIG. 4). A further feature of the invention is that high frequency flux density outside the transformer is canceled as well, thereby creating smaller external leakage field strength which permits higher packaging densities in electronic circuit design.

The present invention is useful in canceling differential mode distortion. The transfer of common mode distortion through the transformer also takes place as a result of capacitance coupling between the primary and secondary windings. In order to stop this transfer, the capacitive coupling between the windings must be minimized. This can be realized by adding electromagnetic shields between the primary and secondary windings, or by implementing special winding configurations in a well known manner. The canceling of common mode distortion does not form part of the present invention.

Figure 6:
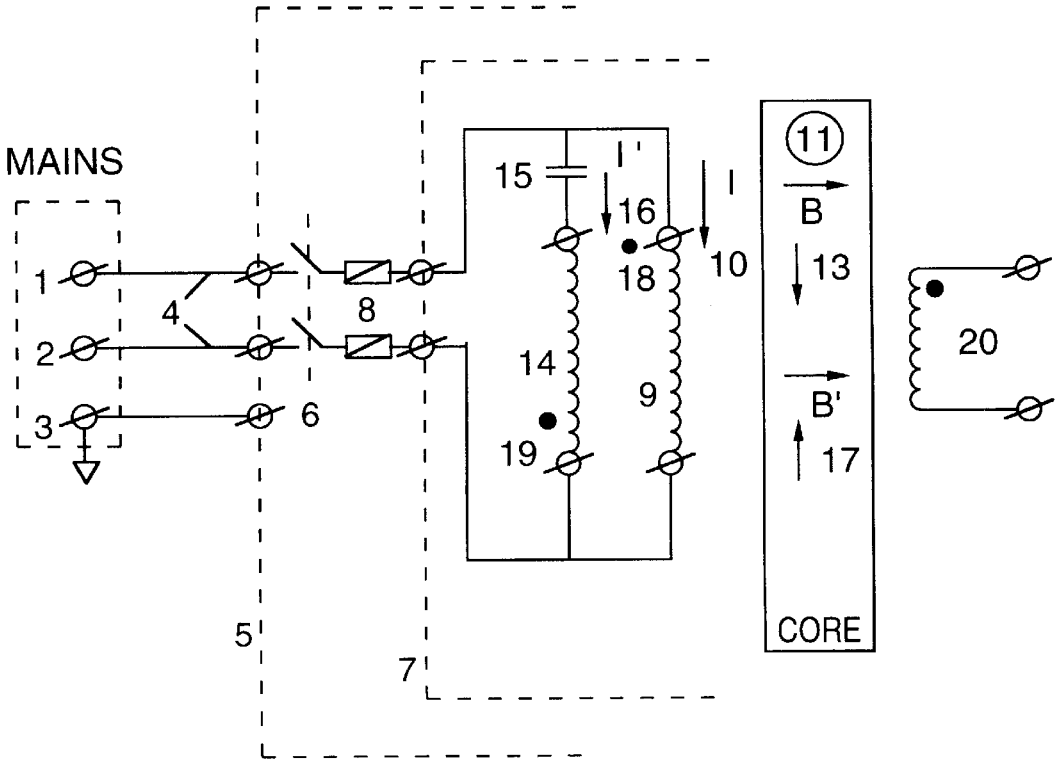
FIG. 6 is a detailed circuit diagram of a preferred embodiment of the invention.

Turning now to the detailed circuit of FIG. 6, a power transformer is shown according to the preferred embodiment a power cord of an electronic device 5 is connected to phases 1 and 2 of a mains power supply. Phase 3 of the power supply is connected to ground and the chassis of the device, in a well known manner. In some cases, grounding of the electronic equipment may not be required. Within the chassis of the equipment or device 5 an on/off switch 6 is provided as well surge protector 8, for connecting and disconnecting the power mains from the equipment.

The power transformer according to the present invention is designated by reference numeral 7. The power mains are connected to primary winding 9 of the power transformer. The phase of the coil is indicated by a dot 18 (wherein phase denotes the direction of the winding (i.e. right handed or left handed winding)). The mains voltage causes an alternating current 10 to flow through the primary winding 9. The current 10 creates an alternating flux density 13 in the magnetic core 11 of the transformer 7.

A second or auxiliary primary winding 14 is provided at the primary side of the transformer, which may either by bifilar round with the primary winding 9 or, as discussed in greater detail below, may be wound in a non-bifilar construction. For the bifilar construction, windings 9 and 14 have the same number of turns and exhibit identical mutual conductance with secondary core 20 via the magnetic core 11.

As shown, the winding 14 is connected in parallel with winding 9 but with opposite phase (dot 19). A passive filter element 15 (e.g. capacitor) is connected in series with the winding 14. As discussed above, the implementation of the present invention is not restricted to a single capacitor. Two capacitors may be used (one on either side of the winding 14, as shown in FIG. 1) or any other frequency dependent structure which functions as a high-pass filter. In general, the high-pass filter element will be of passive construction with an impedance which is inverse to the frequency of signals applied thereto. Other topologies including combinations of inductors and capacitors and resistors may also be used, as well as active filter structures.

An alternating current 16 flows through winding 14 creating an alternating magnetic flux density 17 in the core of the transformer. Because the primary windings 9 and 14 are connected with opposite phase, the flux density 17 in the core 11 is characterized by an opposite vectorial direction to the flux density 13 created by winding 9. The flux densities 13 and 17 therefore cancel out within the magnetic core, wherein the degree of cancellation depends on the frequency of the signal from the mains, the number of turns of windings 9 and 14 and the frequency dependencies of the filter 15, as discussed in greater detail below with reference to FIGS. 7–11.

For very high frequency signals, the impedance of the filter element 15 can be considered to be zero. Where the number of turns in the primary windings 9 and 14 are equal, the flux densities 13 and 17 are equal in magnitude and opposite in phase at the given frequency, thereby canceling each other out completely. The net flux density in the core therefore equals zero at high frequency. Accordingly, there is no coupling of the high frequency signals across the magnetic core to the secondary winding 20.

From the foregoing, it will be apparent that the impedance behavior of the element 15 determines at what frequency the differential mode distortion signals are canceled. Thus, the value of the filter element 15 can be chosen such that at the mains fundamental frequency its impedance is sufficiently large that the current 16 in winding 14 becomes negligible. Then, only the flux density 13 of winding 9 is present in the core 11 and creates an unrestricted voltage in the secondary winding 20. At higher frequencies, the impedance of the filter element 15 decreases, thereby creating the scenario discussed above wherein the net flux density in the core 11 vanishes to almost zero. By selecting predetermined impedances of the filter element 15, the total transfer bandwidth of the transformer can be tuned to exhibit different behavior for different applications, as discussed below.

In the foregoing embodiments, the high pass filter device (e.g. device 15 in FIG. 6) is characterized by a first order high-pass filter structure. Where second or higher order high pass filter structures are required, the device 15 can be replaced by combination of external inductors and capacitors. Thus, it is possible to create a filter structure with the use of active amplifying elements combined with resistors, capacitors and inductors for sensing high frequency content on both the primary and secondary windings and actively regulating the net high frequency content in the core to zero. Enhancements of this sort are contemplated by the inventor as being within the scope of the present invention.

Figure 7:
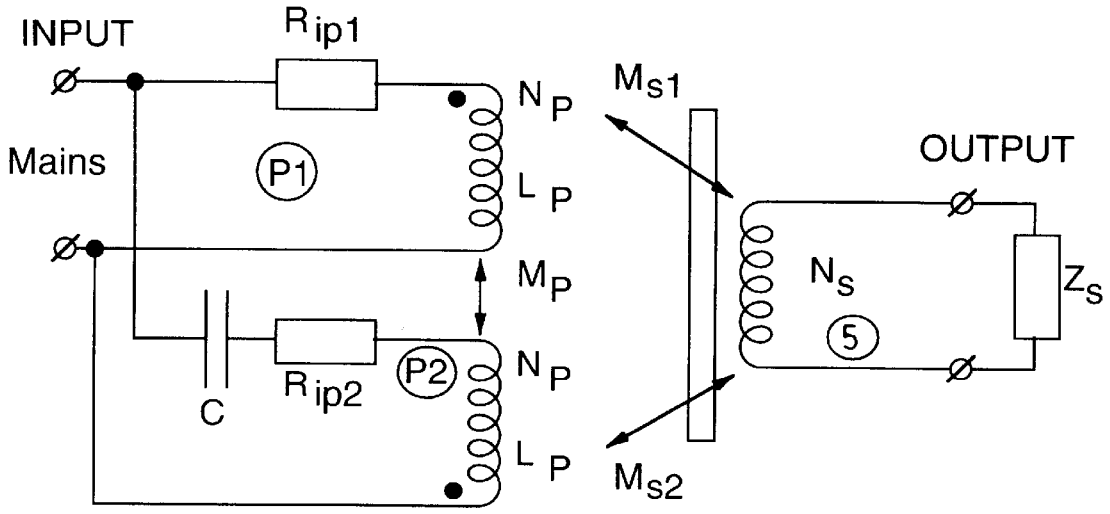
FIG. 7 is a schematic illustration similar to FIG. 1 with a resistance connected in series with the capacitance, thereby forming the high-pass filter device, and with references added representing the number of turns, inductance, internal magnetic wire resistance, impedance and mutual inductance of the transformer.

Turning now to FIG. 7, an embodiment of the invention is shown which is similar to FIG. 1, but which specifies and identifies parameters of the transformer for the purpose of elucidation. Thus, the main primary winding P1 is characterized by having $N_p$ turns, an inductance $L_p$ and internal magnetic resistance $R_{ip1}$, and is connected to the mains having mains frequency f(x). On the secondary side of the transformer, a secondary winding S is provided with $N_s$ turns, an inductance $L_s$ and secondary load $Z_S$ connected thereto (the internal resistance of the winding S is included in $Z_S$). The auxiliary winding P2 plus filtering capacitor C is provided according to the invention with $N_p$ turns, an inductance $L_p$, and an internal plus external resistance $R_{ip2}$. The relative phase of the winding P2 with respect to winding P1 is indicated by the black dot, in the usual manner.

The winding P1 exhibits a mutual inductance toward winding P2 of $M_p=k_p \bullet L_p$ in which $k_p$ is the coupling coefficient between the primary windings P1 and P2. Winding P1 exhibits a mutual inductance with respect to winding P3 of $M_{s1}=k_s\sqrt{L_pL_s}$. Winding P2 exhibits a mutual inductance towards the secondary windings P3 of $M_{s2}=k_2 \bullet M_{s1}$, which indicates that the mutual coupling from between windings P2 and P3 does not have to equal to the mutual coupling from windings P1 and P3.

Turning to FIGS. 8–11, different tuning scenarios are set forth resulting from the selection of different operating parameters for the transformer. In each of FIGS. 8–11 the first graph (graph A) illustrates the transfer function H(x) from input to output in dB for a frequency range f(x)=10 Hz to 100 kHz. According to this graph, a normalized transfer function is considered (i.e. $N_s/N_p=1$). The second graph (graph B) shows total primary impedance ZP(x) of the transformer plus secondary load as measured between the input terminals (i.e. as connected to the mains). The vertical axis in this graph is in kΩ. In the third graph (graph C), the total primary current delivered from the mains to the transformer is shown (IP(x)=Vmains/ZP(x)). The final graph in each of FIGS. 8–11 (graph D) shows the phase angle ΘZP(x) between the primary voltage and current (in degrees).

Turning to the scenario of FIG. 8, the parameters of the circuit in FIG. 7 were chosen such that the windings P1 and P2 were of bifilar construction (i.e. $k_2=1$). The mains voltage was 230 VAC and primary inductance Lp=200 H. The primary winding wires were of equal diameter (i.e. $R_{ip1}=R_{ip2}0.3\ \Omega$). The capacitor C was selected to be $8.8\times10^{-9}$F such that at 60 Hertz (the fundamental means frequency) the phase angle became zero degrees.

Figure 8A:
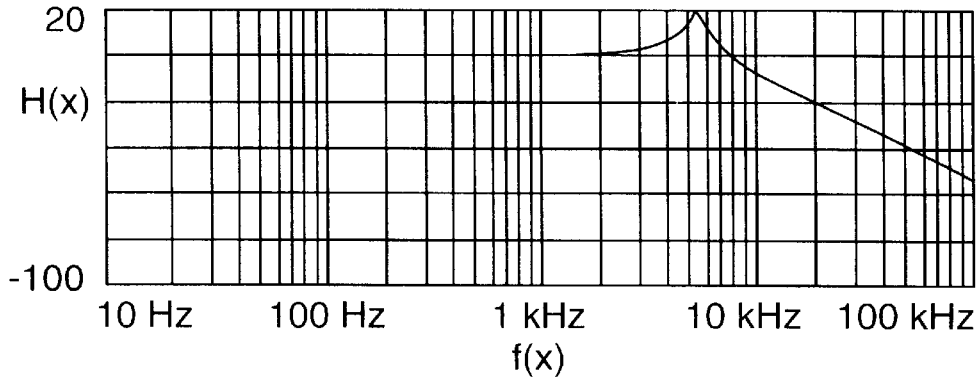
FIGS. 8A–8D show the transfer function, total primary impedance, total primary current from the mains, and phase angle between primary voltage and current as a function of frequency for the circuit of FIG. 7 wherein the primary and auxiliary winding are bifilar constructed.
Figure 8B:
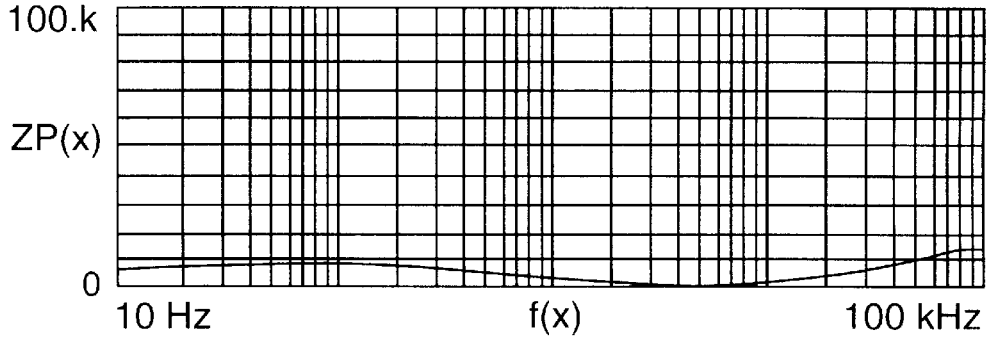
Figure 8C:
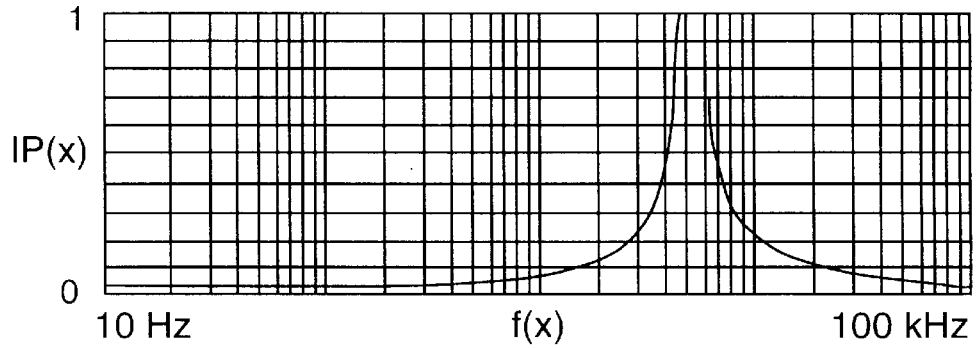
Figure 8D:
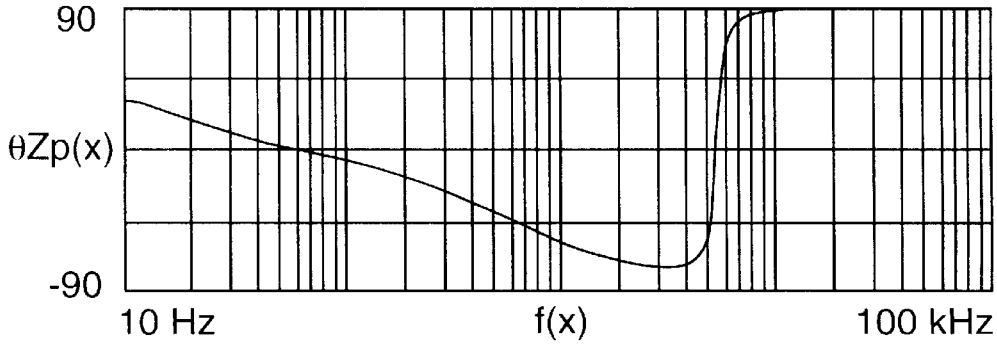

As shown in FIG. 8A, an undamped series resonance developed at 5 kHz where the primary impedance was minimal (i.e. exhibiting reflective behavior) and the primary current therefor was maximized at 5 kHz. Accordingly, with this selection of parameters, bifilar tuning resulted in large high frequency currents.

For the scenario of FIG. 9, the parameters of circuit 7 were similar to those of the scenario of FIG. 8 except that the internal plus external resistance $R_{ip2}$ of the secondary primary winding P2 was increased to 10 kΩ so as to damp the resonance which had been found at 5 kHz.

Figure 9A:
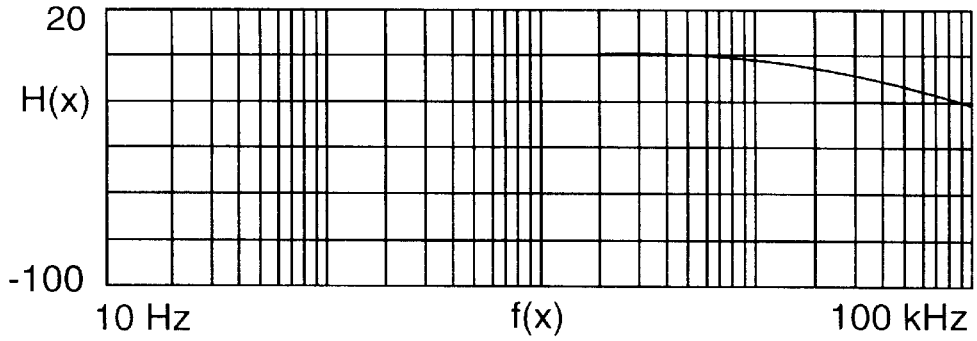
FIGS. 9A–9D represent the same relationships as FIGS. 8A–8D for the circuit of FIG. 7 wherein the primary windings are bifilar but with an increased internal plus external resistance in the auxiliary winding.
Figure 9B:
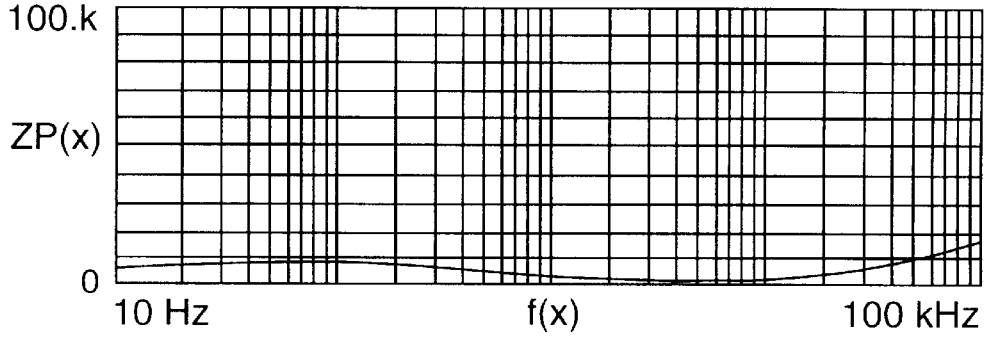
Figure 9C:
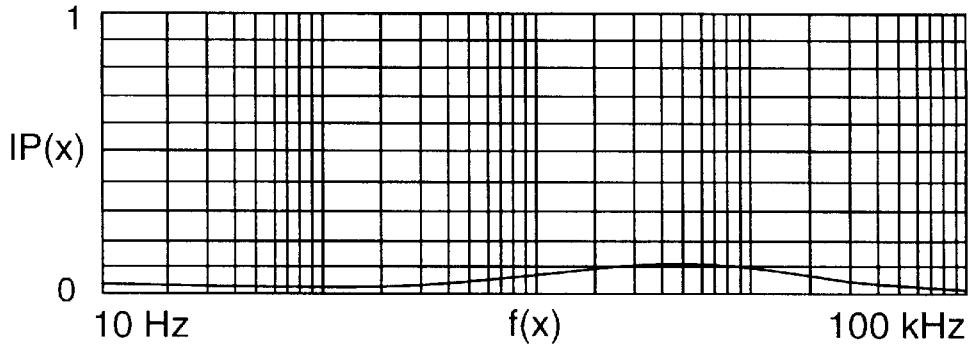
Figure 9D:
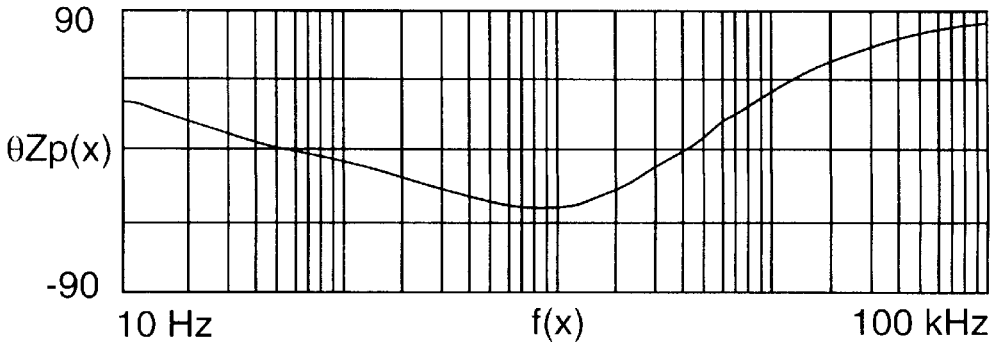
Figure 10A:
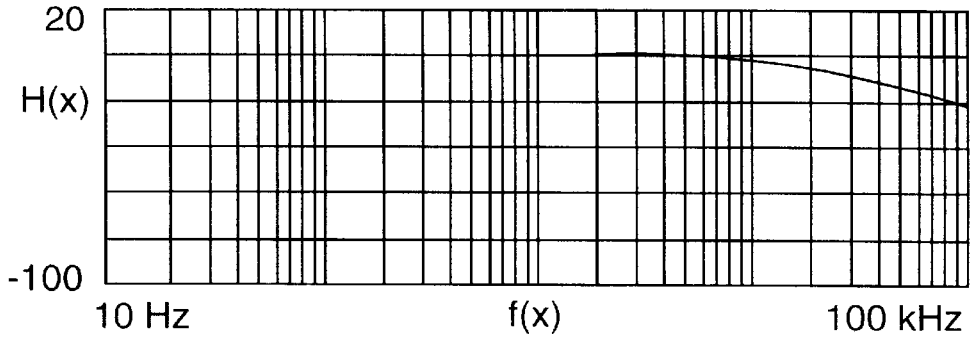
FIGS. 10A–10D represent the same relationships as FIGS. 9A–9D for the circuit of FIG. 7 wherein the additional series capacitance is raised to a higher capacitance level.
Figure 10B:
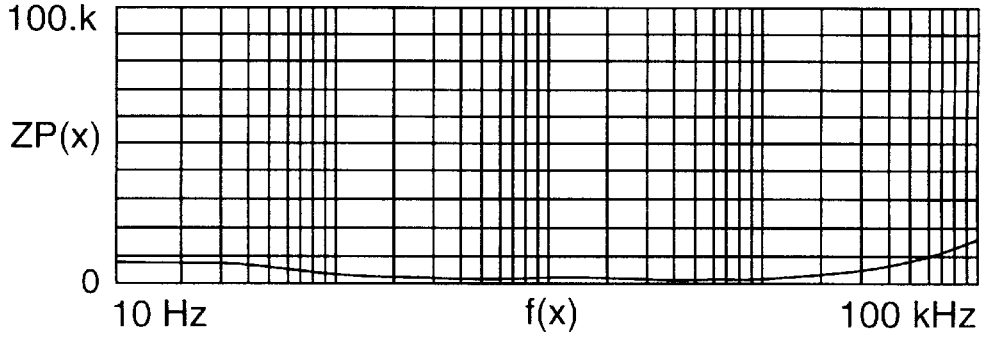
Figure 10C:
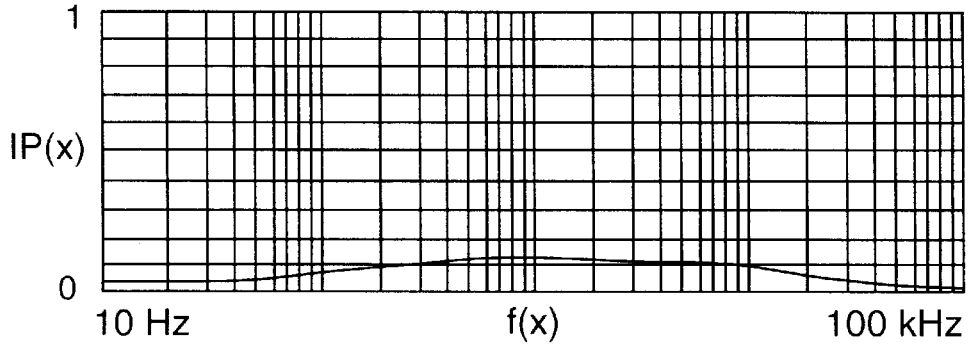
Figure 10D:
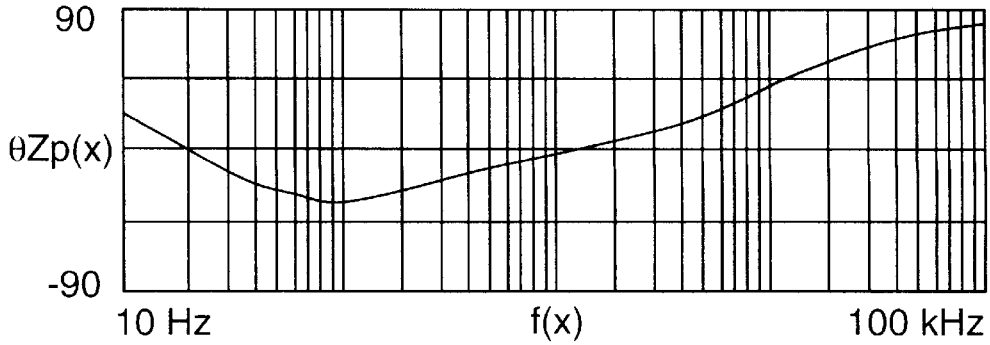
Figure 11A:
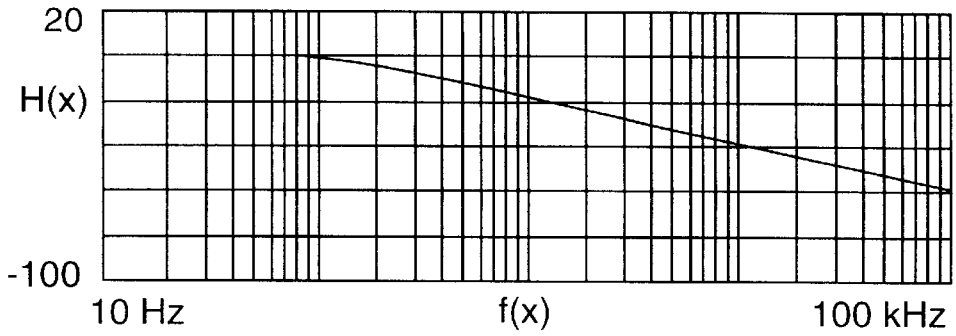
FIGS. 11A–11D represent the same relationships as FIG. 8A–8D for the circuit of FIG. 7 where the windings are not bifilar constructed.
Figure 11B:
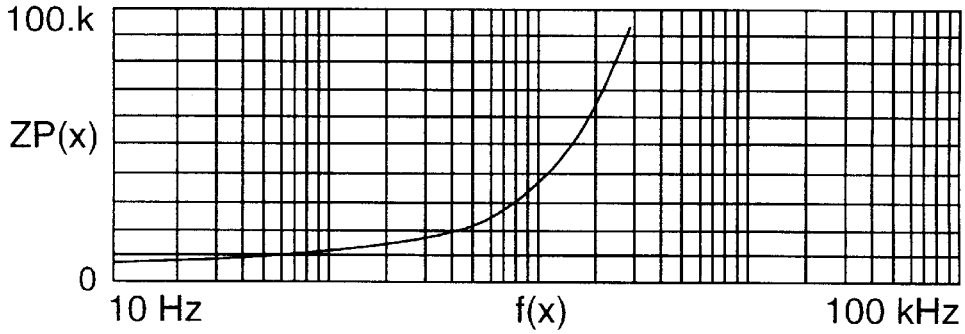
Figure 11C:
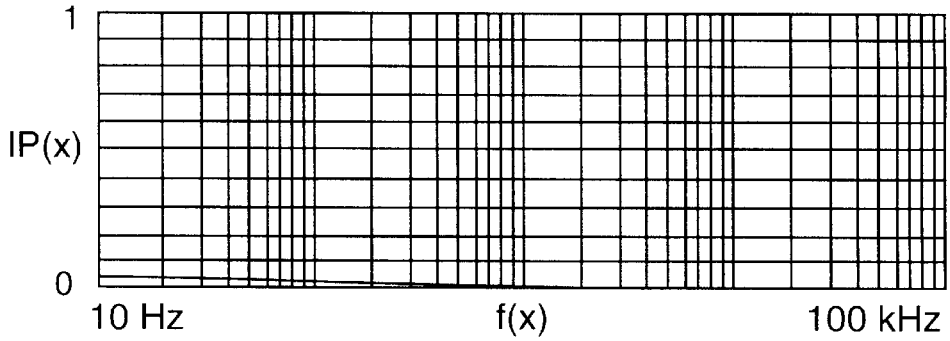
Figure 11D:
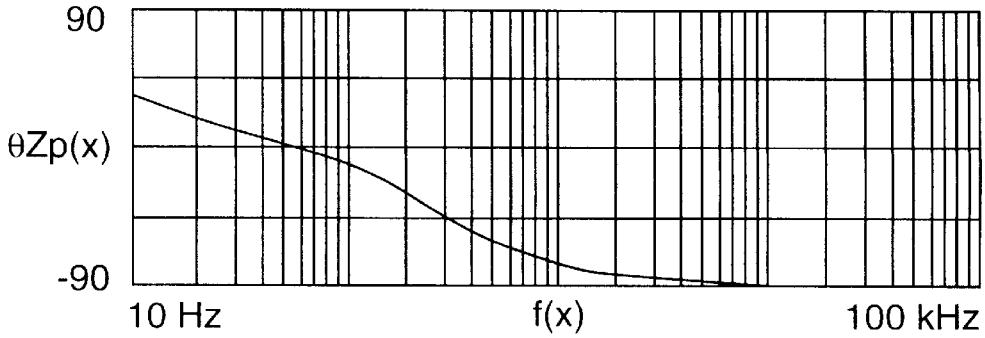

Accordingly, with reference to FIG. 9A, the slope of the transfer function is seen to have changed. Specifically, the increase in primary current at 5 kHz has been reduced. From FIG. 9D it will be seen that the phase angle at 60 Hz remains unaffected. Accordingly, by changing $R_{ip2}$, the slope of the transfer function and the reflecting behavior of the total transformer can be modified.

Turning to FIG. 10, a similar circuit configuration for FIG. 7 was adopted as in the scenario for FIG. 9 except that the capacitance of capacitor C was increased to $8.8\times10^{-8}$F (ten times relative to the scenarios for FIGS. 8 and 9). As seen from. FIG. 10D, the phase angle between the primary current and primary voltage is no longer zero degrees at 60 Hz, but has become zero degrees at 20 Hz. From this, it can be concluded that by varying the capacitance C, the phase angle between primary current and primary voltage can be influenced.

Turning finally to the scenario of FIG. 11, the parameters were selected to be the same as for the configuration of FIGS. 8 and 9 except that the windings P1 and P2 were not bifilar constructed. Instead, winding P1 was wound around the entire toroidal magnetic coil, whereas winding P2 was segmented (e.g. in the area between 12 and 3 o'clock in radial degrees around the core) resulting in an increase in $R_{ip2}$ to 100 kΩ Consequently, the primary mutual coupling $M_p$ becomes less, and the mutual couplings $M_{s1}$ and $M_{s2}$ become unequal (in the present case $k_2=0.9$). The capacitor C was chosen to have the same value as in the cases set forth with reference to FIGS. 8 and 9, resulting in a zero degree phase at 60 Hz between primary current and voltage. The resistance $R_{ip2}$ was increased to 100 kΩ to remove the series resonance at 5 kHz.

Accordingly, it will be appreciated from FIGS. 10A–10D that the cut off frequency and the slope of the effective low pass filter function of the power transformer can be influenced by changing the mutual coupling between the different windings. Impedance increases as a function frequency resulting in very small high frequency primary currents (i.e. non-reflecting behavior), while the primary current at 60 Hz is seen to be influenced mainly by the secondary load $Z_s$.

From the different case studies presented for the circuit of FIG. 7 having regard to the parameters chosen with reference to FIGS. 8–11, it will be seen that the use of different parameters for the transformer of the present invention allows for influencing the transfer function of the transformer, such as cut-off low pass frequency, effective slope of the transfer function, tuning of the phase angle between primary currents and voltages as well as the phase angle between secondary voltages and currents, etc.

Additional modifications and variations of the invention may be conceived by persons of ordinary skill in the art. All such modifications and variations are believed to be within the sphere and scope of the invention as defined by the claims appended hereto.

I claim:

1. A power transformer with internal differential mode distortion cancellation, comprising:

a primary coil for connection to a power source providing a fundamental frequency power signal;

a secondary coil for connection to an electrical load;

a magnetic core intermediate said primary coil and secondary coil for providing mutual magnetic coupling of signals therebetween;

a further coil connected with opposite phase to one of either said primary coil and said secondary coil; and a high-pass filter connected in series with said further coil for attenuating said fundamental frequency power signal while passing high frequency distortion signals substantially unattenuated, whereby said high frequency distortion signals are canceled in said magnetic core.

2. The power transformer of claim 1, comprising an additional coil connected with opposite phase to the other of said one of either said primary coil and said secondary coil and a further high-pass filter connected in series with said additional coil.

3. The power transformer of claim 1, wherein said high-pass filter comprises a capacitor.

4. The power transformer of claim 1, wherein said high-pass filter comprises a pair of capacitors connected to opposite sides of said further coil.

5. The power transformer of claim 1, wherein said high pass filter comprises a resistor connected in series to a capacitor.

6. The power transformer of claim 2, wherein said further high-pass filter comprises a capacitor.

7. The power transformer of claim 2, wherein said further high-pass filter comprises a pair of capacitors connected to opposite sides of said additional coil.

8. The transformer of claim 2, wherein said further high-pass filter comprises a resistor connected in series to a capacitor.

9. The power transformer of claim 1 wherein said one of said primary coil and said secondary coil is bifilar wound with said further coil.

10. The power transformer of claim 2 wherein said other one of said one of either said primary coil and said secondary coil is bifilar wound with said additional coil.

11. The power transformer of claim 5, wherein said capacitor has a capacitance selected to result in a zero degree phase angle between current and voltage in said one of either said primary coil and secondary coil at said fundamental frequency.

12. The power transformer of claim 5, wherein said resistor has a resistance selected to dampen any series resonance in said transformer at frequencies above said fundamental frequency.

13. The power transformer of claim 11, wherein said one of said primary coil and said secondary coil is wound with said further coil using other than bifilar wound construction such that mutual coupling between said one of said primary coil and secondary coil and said other of said primary coil and secondary coil is not equal to mutual coupling between said further coil and said other of said primary coil and secondary coil.

14. The power transformer of claim 12 wherein said capacitor has a capacitance selected to result in a predetermined phase angle between current and voltage in said one of either said primary coil and secondary coil.

15. The power transformer of claim 12, wherein said one of said primary coil and said secondary coil is wound with said further coil using other than bifilar wound construction such that mutual coupling between said one of said primary coil and secondary coil and said other of said primary coil and secondary coil is not equal to mutual coupling between said further coil and said other of said primary coil and secondary coil.

* * * * *